US007795513B2

(12) United States Patent
Luttwak

(10) Patent No.: US 7,795,513 B2
(45) Date of Patent: Sep. 14, 2010

(54) STRINGED MUSICAL INSTRUMENTS, AND METHODS OF MAKING THE SAME

(76) Inventor: Joseph E. Luttwak, 647 Spruce St., San Francisco, CA (US) 94118

( * ) Notice: Subject to any disclaimer, the term of this patent is extended or adjusted under 35 U.S.C. 154(b) by 284 days.

(21) Appl. No.: 11/968,618

(22) Filed: Jan. 2, 2008

(65) Prior Publication Data

US 2008/0156168 A1 Jul. 3, 2008

Related U.S. Application Data

(60) Provisional application No. 60/883,200, filed on Jan. 3, 2007.

(51) Int. Cl.
*G10D 1/08* (2006.01)

(52) U.S. Cl. ..... 84/267; 84/291

(58) Field of Classification Search ..... 84/267, 84/290, 291

See application file for complete search history.

(56) References Cited

U.S. PATENT DOCUMENTS

| | | | |
|---|---|---|---|
| 168,665 | A | 10/1875 | Oehrlein, Jr. |
| 518,775 | A | 4/1894 | Bluer |
| 536,846 | A | 4/1895 | Bates |
| 812,049 | A | 2/1906 | Krueger |
| 1,733,595 | A | 10/1929 | Greenfield |
| 4,144,793 | A | 3/1979 | Soika et al. |
| 4,145,948 | A | 3/1979 | Turner |
| D253,352 | S | 11/1979 | Kaman |
| 4,200,023 | A | 4/1980 | Kaman |
| 4,213,370 | A | 7/1980 | Jones |
| 4,290,336 | A | 9/1981 | Peavey |
| 4,313,362 | A | 2/1982 | Lieber |
| 4,353,862 | A | 10/1982 | Kaman, II |
| 4,359,923 | A | 11/1982 | Brunet |
| 4,364,990 | A | 12/1982 | Haines |
| 4,408,516 | A | 10/1983 | John |
| 4,429,608 | A | 2/1984 | Kaman et al. |
| 4,846,039 | A | 7/1989 | Mosher |
| 4,969,381 | A | 11/1990 | Decker, Jr. et al. |
| 5,333,527 | A | 8/1994 | Janes et al. |
| 5,895,872 | A | 4/1999 | Chase |
| 5,911,168 | A | 6/1999 | Enserink |

(Continued)

FOREIGN PATENT DOCUMENTS

| | | | |
|---|---|---|---|
| DE | 196 40 278 | A1 | 4/1998 |

OTHER PUBLICATIONS

Goodwinds.com catalog, merchant for structural tubing, carbon and fiberglass, search for "tube" © 2003-2009 viewed Nov. 12, 2009 at www.goodwinds.com, 5 pages.

(Continued)

*Primary Examiner*—Kimberly R Lockett
(74) *Attorney, Agent, or Firm*—Kang S. Lim

(57) ABSTRACT

Stringed musical instruments, and methods for manufacturing such instruments, are provided that include a unitary shell that includes a head, a neck and a body, a separate sound board adapted to be attached to the unitary shell, wherein the soundboard extends from the head to the body, and a substantially hollow cavity extending through the head, the neck and the body. Exemplary processes include composite manufacturing processes and plastics manufacturing processes.

21 Claims, 25 Drawing Sheets

U.S. PATENT DOCUMENTS

| | | | | |
|---|---|---|---|---|
| 5,955,688 | A | 9/1999 | Cook | |
| 6,060,650 | A | 5/2000 | McPherson | |
| 6,087,568 | A | 7/2000 | Seal | |
| 6,103,961 | A | 8/2000 | Kaufman | |
| 6,107,552 | A | 8/2000 | Coomar et al. | |
| 6,255,566 | B1 * | 7/2001 | Bly | 84/291 |
| 6,372,970 | B1 | 4/2002 | Saunders, Jr. et al. | |
| 6,610,915 | B2 | 8/2003 | Schleske | |
| 6,664,452 | B1 | 12/2003 | Teel | |
| 6,683,236 | B2 | 1/2004 | Davis et al. | |
| 6,770,804 | B2 | 8/2004 | Schleske | |
| 7,151,210 | B2 | 12/2006 | Janes et al. | |
| 2002/0104423 | A1 | 8/2002 | Verd | |
| 2003/0070528 | A1 | 4/2003 | Davis et al. | |

OTHER PUBLICATIONS

Goodwinds.com catalog, merchant for structural tubing, carbon and fiberglass, search for "tapered" © 2003-2009 viewed Nov. 16, 2009 at www.goodwinds.com, 6 pages.

* cited by examiner

STRINGED MUSICAL INSTRUMENTS, AND METHODS OF MAKING THE SAME

REFERENCE TO RELATED APPLICATIONS

This application claims the benefit of U.S. Provisional Application Ser. No. 60/883,200, filed 3 Jan. 2007, which is incorporated by reference herein in its entirety.

BACKGROUND

This invention relates to stringed musical instruments, such as guitars, and to methods for making such stringed instruments.

Stringed instruments traditionally have been constructed of wood, but also have been fabricated from plastics, molded composite materials, and combinations of such materials. As shown in FIG. 1, a conventional stringed instrument typically includes a body 10, a neck 12, a head 14 (sometimes called a "headstock"), a sound board 16, a fingerboard 18 (sometimes called a "fretboard"), strings 20, a bridge 22 and a sound hole 24. In acoustic stringed instruments the interior of body 10 is hollow, and forms a resonant cavity, often called a "sound chamber." In acoustic stringed instruments, the vibration of strings 20 is transmitted through bridge 22 to the body via sound board 16. In turn, the vibration of sound board 16 vibrates air inside the sound chamber, and produces the sound that is projected from sound hole 24.

In many conventional stringed instruments, the various components are constructed separately, and then joined to form a finished instrument. Because the structural integrity of a stringed instrument affects the tonal quality and sound output of the instrument, stringed instruments made from separately joined parts experience some loss in sound quality. In addition, in many conventional stringed instruments, the neck 12 and head 14 are made of solid material, which decreases the volume and tonal range of the instrument because the added weight dampens resonance. Generally speaking, a lighter instrument is better than a heavier one. The most expensive and resonant guitars typically are very light. Further, solid neck and head components reduce the "sustain" of the instrument—that is, the length of time that the strings "ring" when played.

Small-bodied stringed instruments, such as small-bodied acoustic guitars designed for travel, are particularly susceptible to sound degradation attributable to design and manufacturing considerations. In particular, small-bodied stringed instruments typically have a relatively small sound chamber, and thus have reduced volume and tonal range compared with that of normal-sized stringed instruments. The sound degradation for small-bodied stringed instruments is further exacerbated by use of a solid neck. In addition, a common problem with small-bodied acoustic guitars is that the solid neck is heavier than the hollow body, which requires the user to awkwardly elevate the neck to play the instrument.

Some designers and manufacturers have sought to improve sound quality or structural integrity of stringed instruments by providing a hollow neck that forms an enclosed passage that communicates with the sound chamber and one or more sound holes located at the headstock. Such "expanded sound chamber" designs benefit from the continuous hollow sound chamber between the body and neck. However, such previously known designs typically are fabricated from numerous separate components that must be attached to form the finished instrument. Thus, the improvement in sound quality resulting from the expanded sound chamber is offset by the lack of structural integrity and resulting degradation in sound quality attributable to construction from separate parts.

As an alternative approach, some designers and manufacturers have sought to improve sound quality or structural integrity of stringed instruments by fabricating instruments using so-called "one-piece" designs that reduce the number of separate components that must be joined to form the finished instrument. Although such "unitary" stringed instruments offer some improvements over conventional designs, they each suffer from significant drawbacks that negatively impact sound quality and/or manufacturability.

Indeed, some form of unitary stringed instruments appeared in the late $19^{th}$ century. Such instruments were typically constructed of wood, were extremely time-consuming to manufacture, and were very fragile. More recently, guitar designers and manufacturers have created molded unitary stringed instruments using composite and/or injection-molding techniques. However, such molded unitary stringed instruments typically include numerous shortcomings, and/or fail to provide an instrument that is designed for optimal resonance and superior sound quality.

For example, some previously known "unitary" stringed instruments are actually use a separate neck that must be attached to a unitary body, which defeats the benefits gained from unitary construction techniques. Other prior art unitary stringed instruments use a neck that is strengthened using internal assemblies that make the instrument very heavy and thus reduces the resonance of the instrument. Some previously known stringed instruments are fully unitary, but include rigid soundboards that are not suitable for acoustic stringed instruments.

Some prior art stringed instruments have attempted to combine the benefits of unitary construction and expanded sound chamber design. However, such "combination" designs fail to achieve an instrument that is easy to manufacture, structurally sound and highly resonant. It would be desirable to provide such stringed musical instruments, and methods for making such instruments.

SUMMARY

Apparatus and methods in accordance with this invention provide stringed musical instruments that include a unitary shell that includes a head, a neck and a body, a separate sound board adapted to be attached to the unitary shell, wherein the soundboard extends from the head to the body, and a substantially hollow cavity that extends through the head, the neck and the body.

Exemplary processes in accordance with the invention include composite manufacturing processes that include providing a mold to form a unitary shell comprising a head, a neck and a body, providing a plurality of pieces of fiber cloth in the mold, adding a resin to saturate the fiber cloth, applying pressure to the fiber cloth in the mold, curing the resin to form the unitary shell, attaching a separate sound board the unitary shell, wherein the soundboard extends from the head to the body, and providing a substantially hollow cavity in the unitary shell extending through the head, the neck and the body.

Alternative exemplary manufacturing processes in accordance with this invention include injection molding, compression molding, vacuum forming and other similar processes.

Exemplary soundboards in accordance with this invention may be manufactured from a fabric resin matrix, plastics, fiber-reinforced plastics, ceramics or wood.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION

Figure 1:
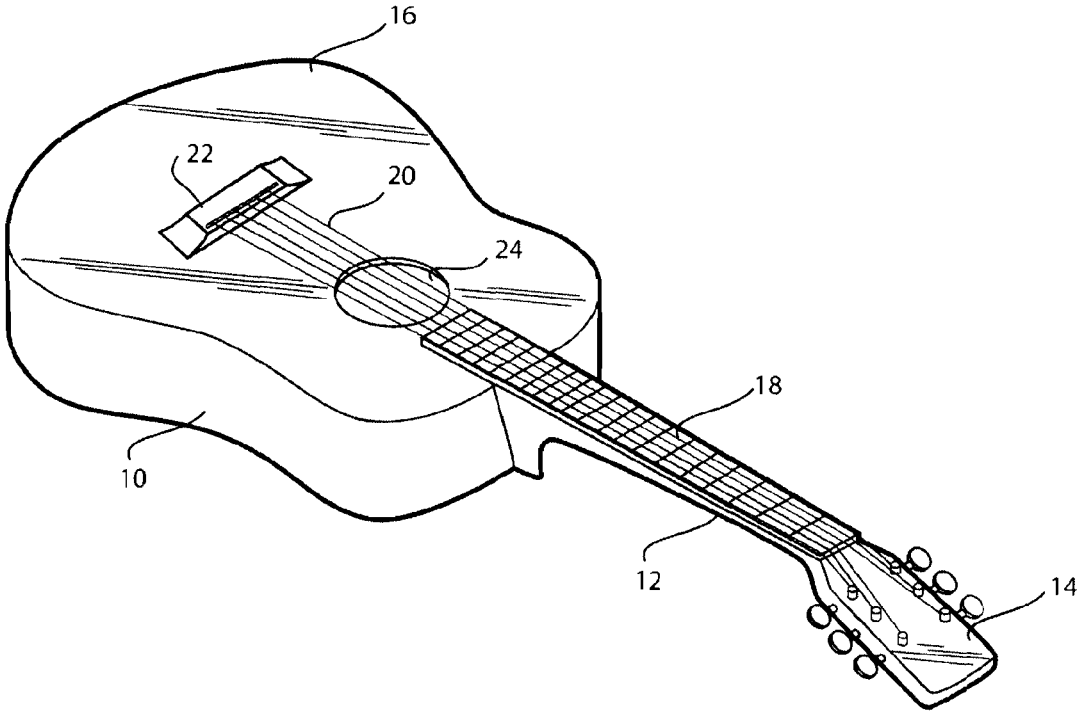
FIG. 1 (PRIOR ART)
FIG. 1 is perspective view of a conventional stringed instrument.
Figure 2A:
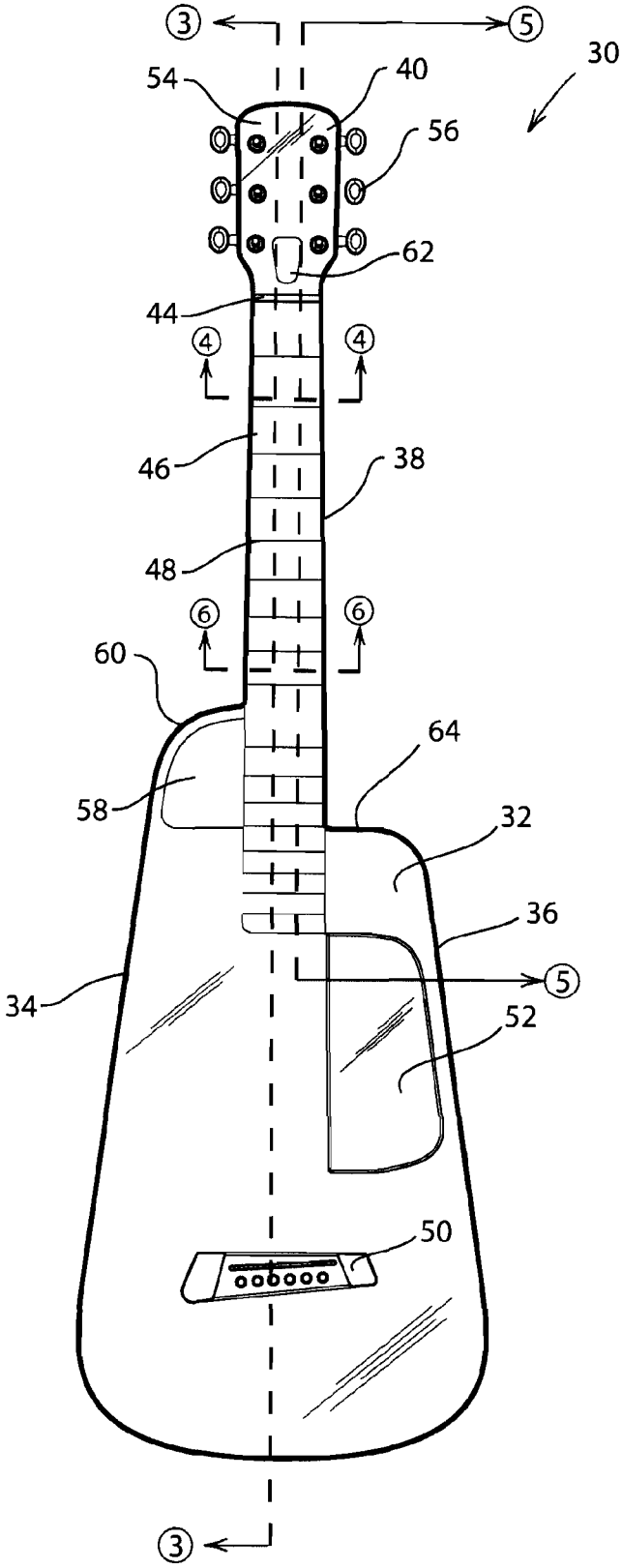
FIG. 2A-2D are top plan view, left perspective view, right perspective view, and bottom plan view, respectively, of an exemplary stringed instrument in accordance with this invention.
Figure 2B:
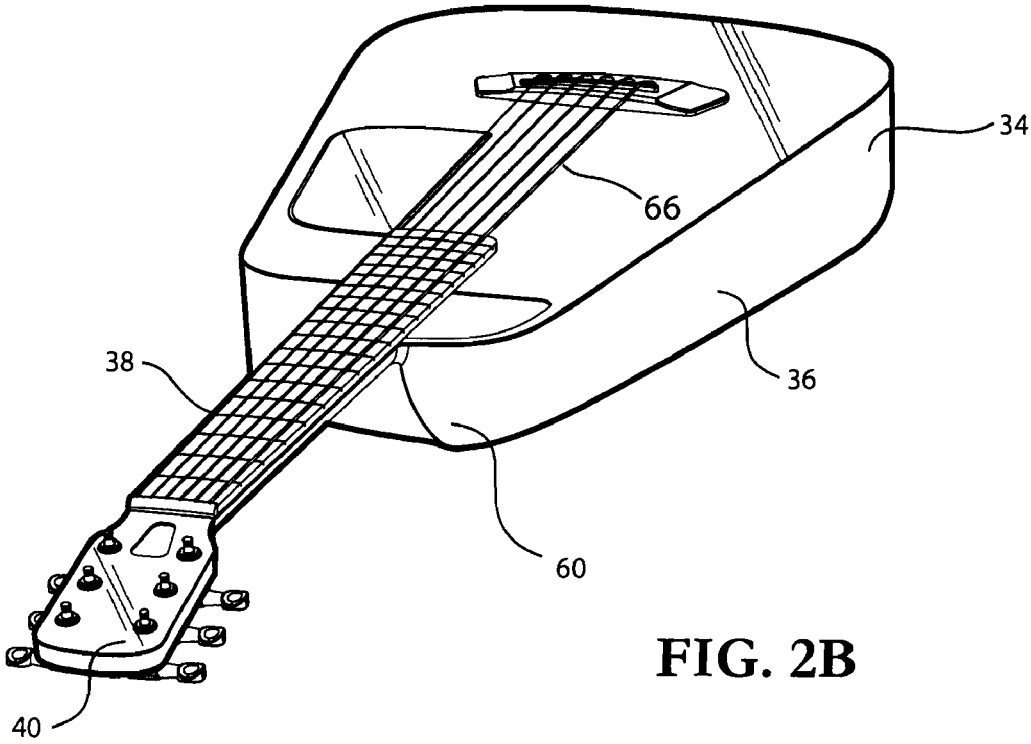
Figure 2C:
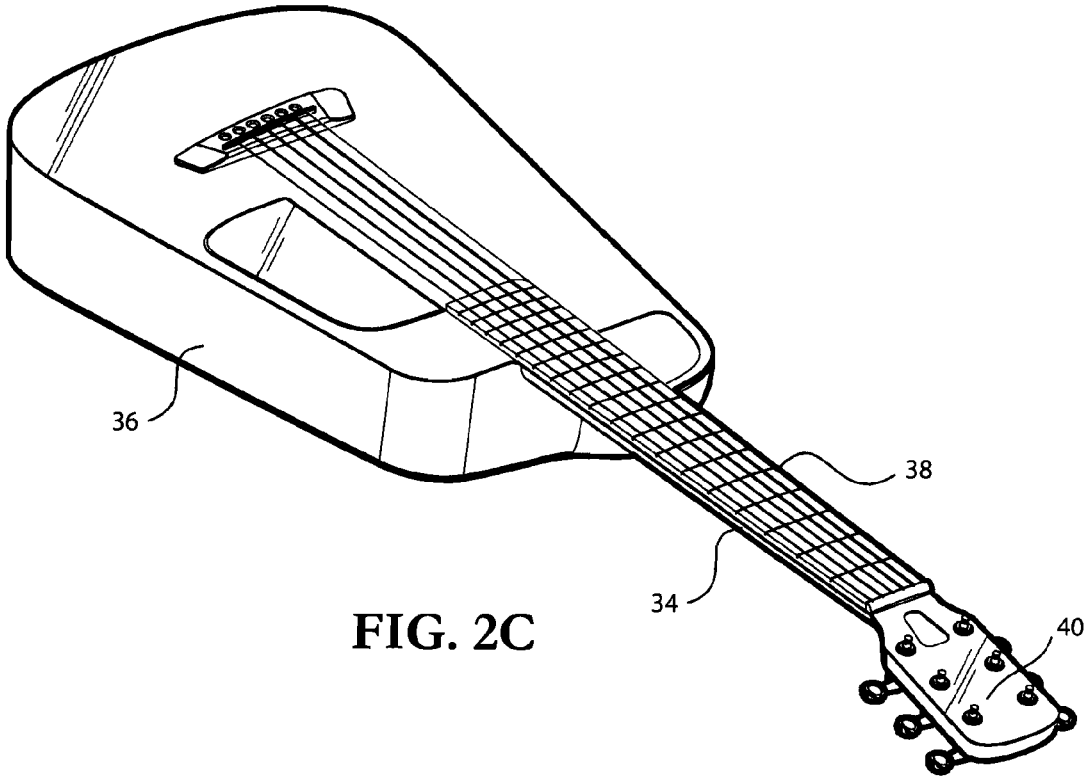
Figure 2D:
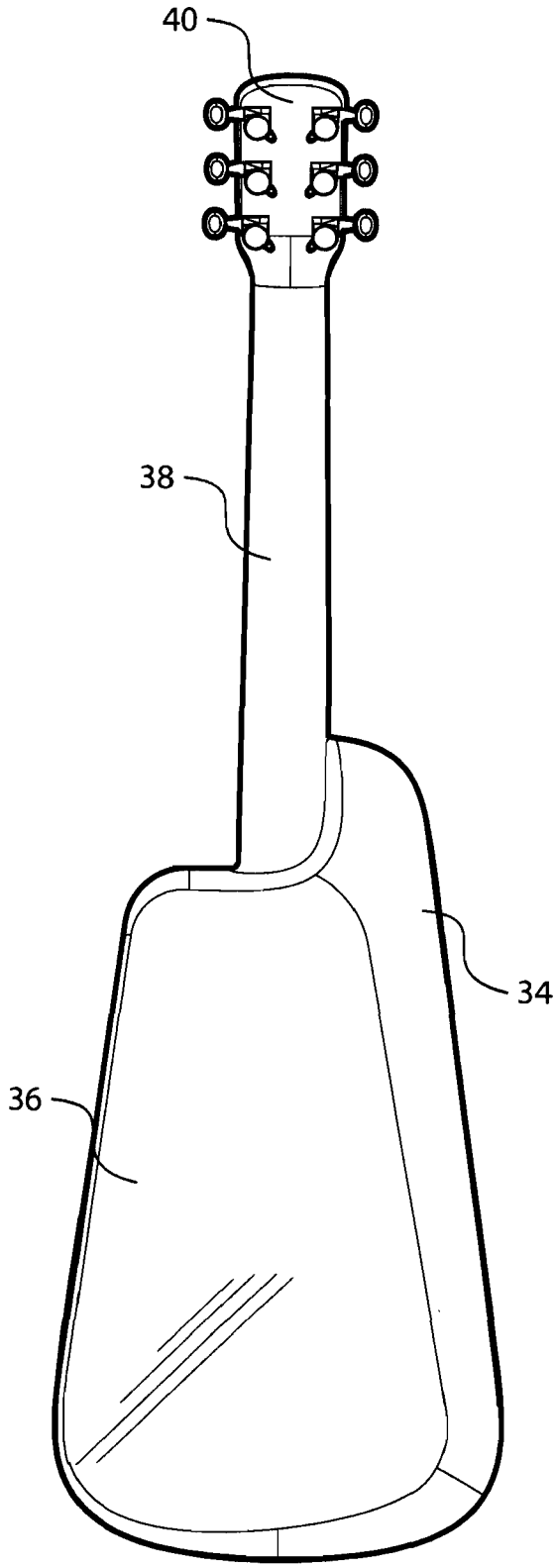
Figure 3:
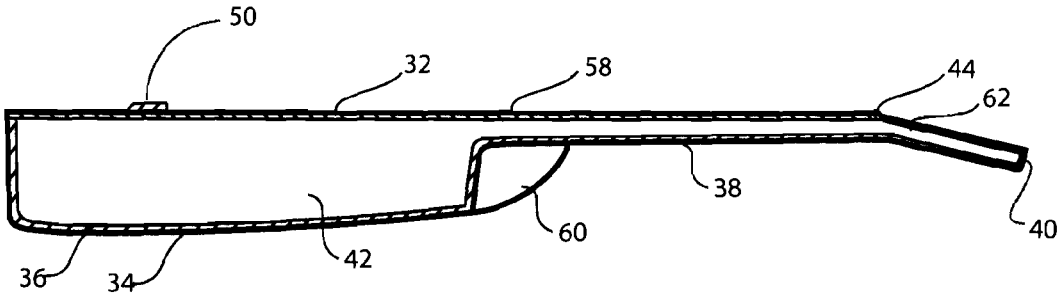
FIG. 3 is a cross-sectional view of the exemplary stringed instrument of FIG. 2.

An first exemplary embodiment of a stringed instrument in accordance with this invention is illustrated in FIGS. 2 and 3. Exemplary stringed instrument 30 includes a soundboard 32 and a unitary shell 34 that includes a body 36, a neck 38 and a head 40. As described in more detail below, unitary shell 34 may be formed by composite manufacturing processes, plastics manufacturing processes, or other similar processes, or combinations of such processes. Unitary shell 34 includes a cavity 42 extending from body 36 through neck 38 to head 40. Soundboard 32 is fixedly attached to unitary shell 34, such as by adhesives, fasteners, welds, snap-fit (e.g., as in plastic parts) or any combination thereof. Exemplary adhesives include, glue, epoxy, or other similar adhesives. Exemplary fasteners include nails, rivets, staples, or other similar fasteners.

Soundboard 32 extends from body 36, along neck 38 to a nut 44 mounted to head 40. A fingerboard 46, which includes upraised frets 48, a bridge 50 and a pickguard 52 are mounted to soundboard 32. In addition, a head top 54 is mounted to head 40 and to soundboard 32, and tuners 56 are mounted to head 40 and head top 54. Soundboard 32 includes a first sound hole 58 disposed above a body extension 60 in body 36. Head top 54 includes a second sound hole 62. Further, body 36 includes a cutaway portion 64 to form an asymmetry on one side of stringed instrument 30. Strings 66 stretch from bridge 50 over frets 48 to nut 44, and are attached to tuners 56. As shown in FIG. 3, when soundboard 32 and unitary shell 34 are joined, cavity 42 forms an elongated resonance chamber that communicates with first sound hole 58 and second sound hole 62, and that extends from body 36 through neck 38 and head 40. Persons of ordinary skill in the art will understand that head top 54 optionally may be eliminated, whereby second sound hole 62 effectively encompasses substantially the entire area of head 40.

The exemplary stringed instrument illustrated in FIGS. 2 and 3 is generally in the form of an acoustic guitar. Persons of ordinary skill in the art will understand that principles of the present invention may be applied to other stringed instruments, such as classical guitars, twelve-string guitars, electric guitars, electric acoustic guitars, jazz guitars, violins, violas, cellos, bass, double bass, citterns, lutes, mandolins, mandolas, mandocellos, ukuleles, banjos, and other similar stringed instrument.

Figure 4:
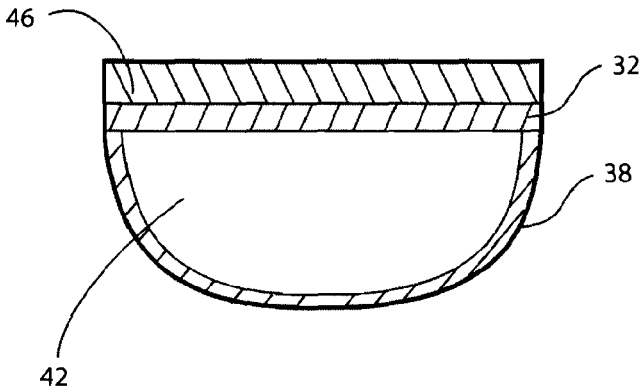
FIG. 4 is a cross-sectional view of a neck portion of the exemplary stringed instrument of FIG. 3.

The portion of cavity 42 in neck 38 may have various cross-sectional configurations. For example, FIG. 4 illustrates a cross-section of an exemplary neck 38 that includes a single semi-circular cavity area 42. Persons of ordinary skill in the art will understand that the portion of cavity 42 in neck 38 may have other cross-sectional shapes, such as circular, elliptical, crescent-shaped, or other similar shape, and may include more than one cavity.

Figure 5A:
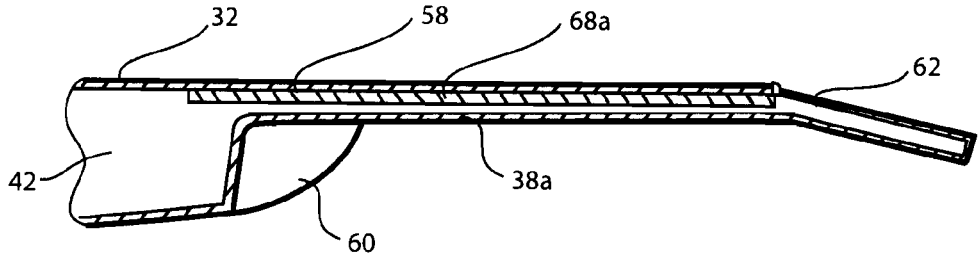
FIGS. 5A-5C are cross-sectional views of alternative exemplary stringed instruments in accordance with this invention.
Figure 6A:
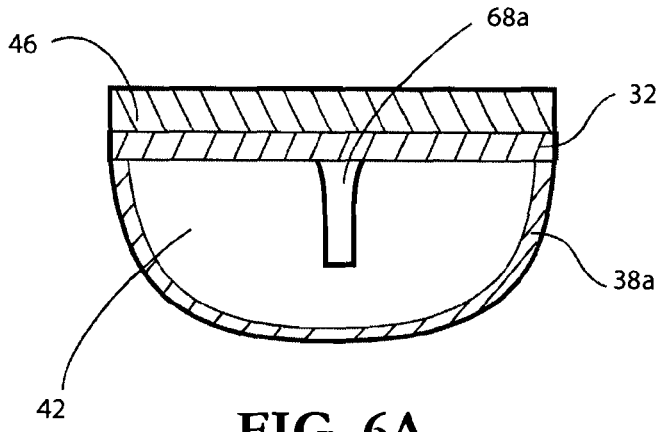
FIGS. 6A-6C are cross-sectional views of neck portions of alternative exemplary stringed instruments in accordance with this invention.

For example, FIGS. 5A and 6A illustrate an alternative exemplary neck 38*a* that includes a vertical bracing element 68*a* that extends substantially the entire length of neck 38*a* in hollow cavity 42. Bracing element 68*a* may be used to provide additional structural support to neck 38*a* to prevent neck 38*a* from bending in response to tension on strings 66, but without substantially obscuring the portion of cavity 42 in neck 38, or preventing that portion from communicating with first sound hole 58 and second sound hole 62. Bracing element 68*a* may be made of aluminum, carbon-fiber rods, or other similar light-weight, stiff material. The bracing may be adjustable such as an adjustable truss rod to modify the curvature of the fingerboard. Although bracing element 68*a* is shown as a single element, persons of ordinary skill in the art will understand that bracing element 68*a* may include more than one element. In addition, the configuration of bracing element 68*a* inside hollow cavity 42 may vary depending on the type of stringed instrument.

Figure 5B:
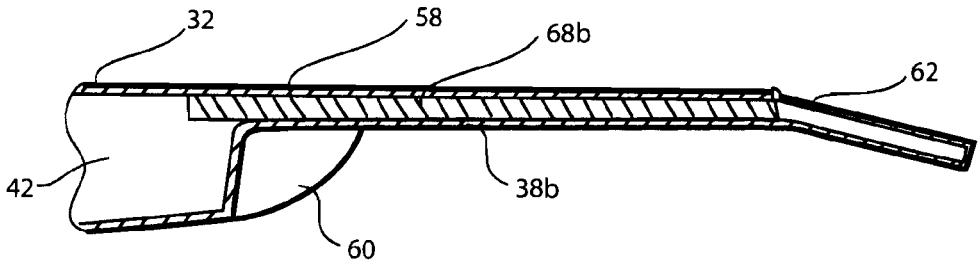
Figure 5C:
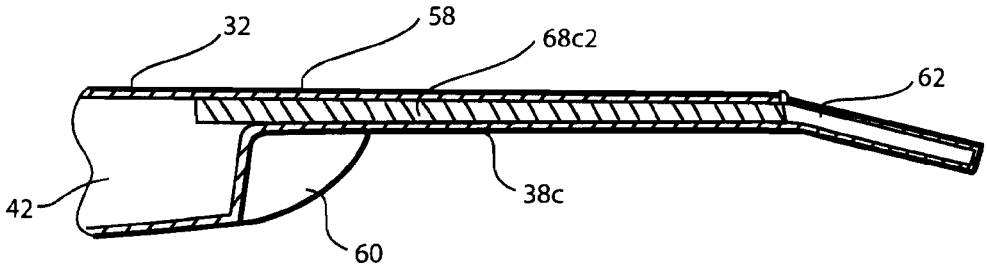
Figure 6B:
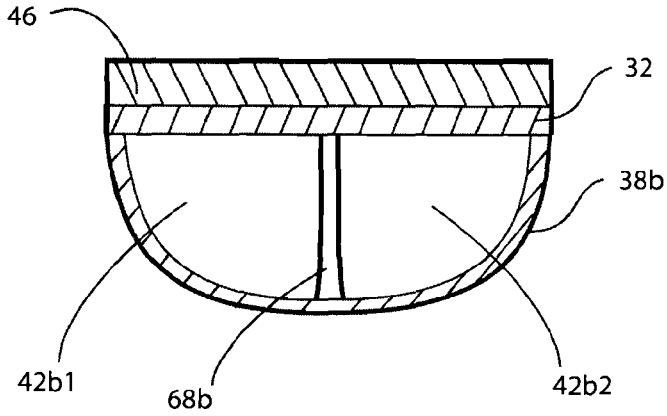
Figure 6C:
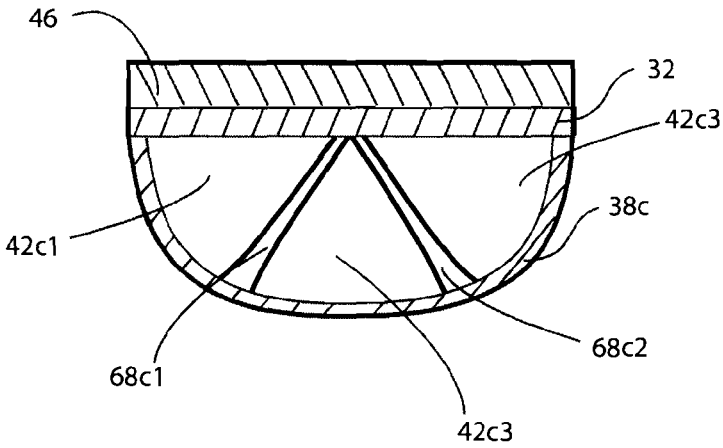

For example, FIGS. 5B and 6B illustrate an alternative exemplary neck 38*b* that includes a bracing element 68*b* that extends substantially the entire length of neck 38*b* in hollow cavity 42, and that bisects cavity 42 to form two sub-cavities 42*b*1 and 42*b*2, each of which communicates with first sound hole 58 and second sound hole 62. Likewise, as shown in FIGS. 5C and 6C, alternative exemplary neck 38*c* includes a pair of bracing elements 68*c*1 and 68*c*2 that extend substantially the entire length of neck 38*c* in hollow cavity 42, and subdivide cavity 42 into three sub-cavities 42*c*1, 42*c*2, and 42*c*3, each of which communicates with first sound hole 58 and second sound hole 62.

Figure 7A:
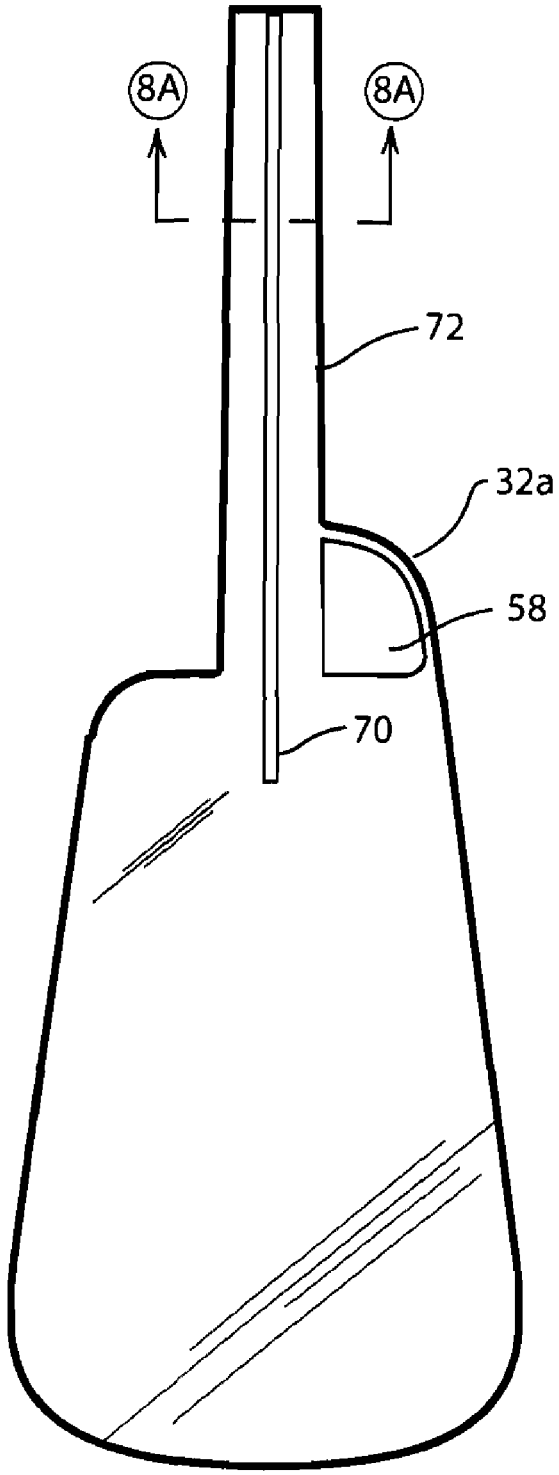
FIGS. 7A-7D are bottom plan views of exemplary soundboards in accordance with this invention.
Figure 8A:
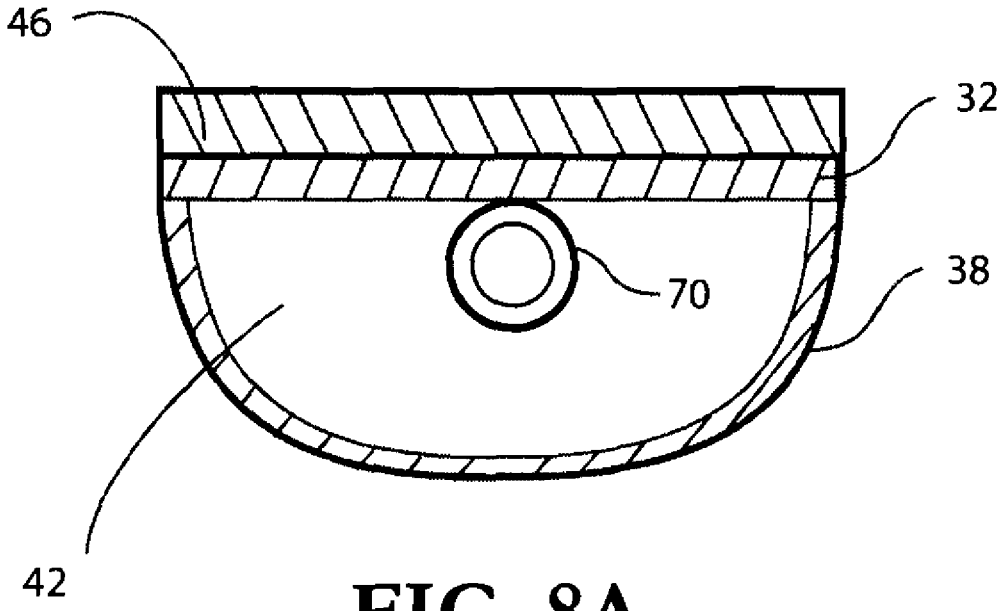
FIGS. 8A and 8B are cross-sectional views of exemplary neck portions corresponding to the views of FIGS. 7A and 7B, respectively.

Person of ordinary skill in the art will understand that other techniques may be used to provide structural support for neck 38. For example, FIG. 7A illustrates the underside of an exemplary soundboard 32*a* that includes a reinforcing tube 70 that is disposed along neck portion 72 of soundboard 32*a*. FIG. 8A illustrates a corresponding cross-sectional view of neck 38 with soundboard 32*a* attached, showing reinforcing tube 70 disposed inside hollow cavity 42. Reinforcing tube 70 preferably is made of a lightweight, strong, rigid tube, such as filament wound, unidirectional carbon tubes, or other similar tubes. Tube 70 add stiffness to neck portion 72 of soundboard 32, which in turn adds stiffness to neck 38, but without substantially obscuring the portion of cavity 42 in neck 38, or preventing that portion from communicating with first sound hole 58 and second sound hole 62. Persons of ordinary skill in the art will understand that tubes 70 may be hollow tubes or solid rods, adjustable and may be circularly or non-circularly-shaped.

Figure 7B:
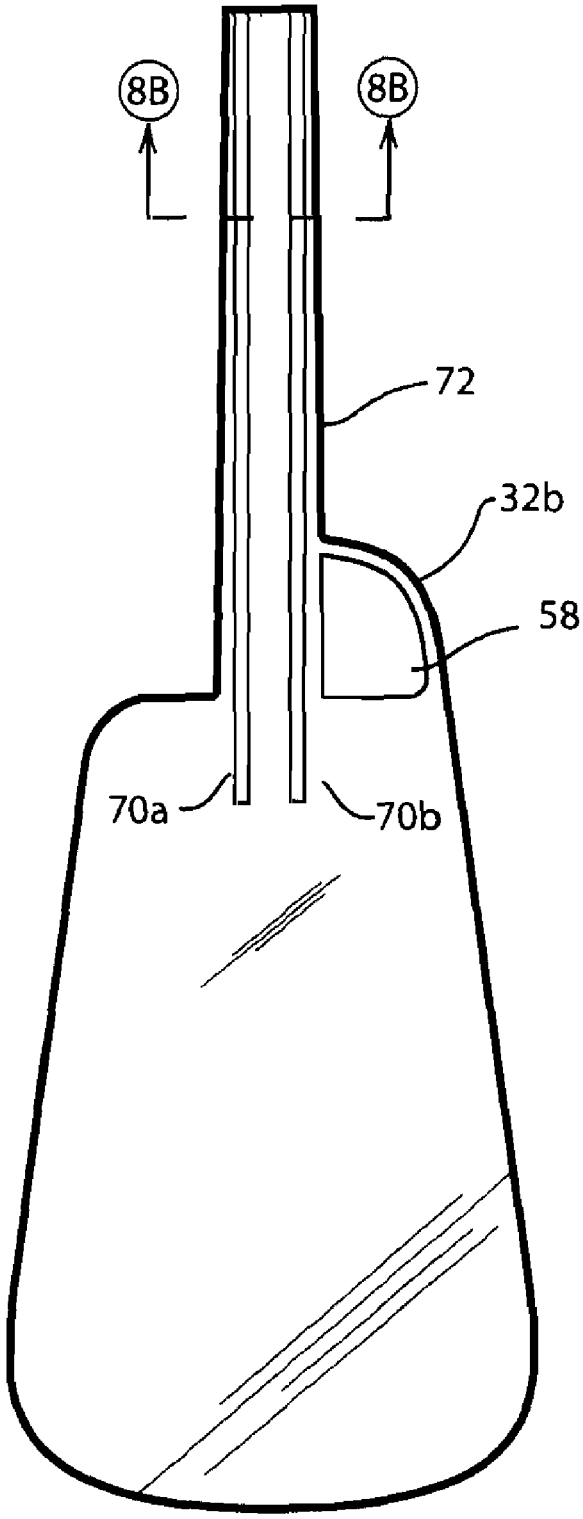
Figure 8B:
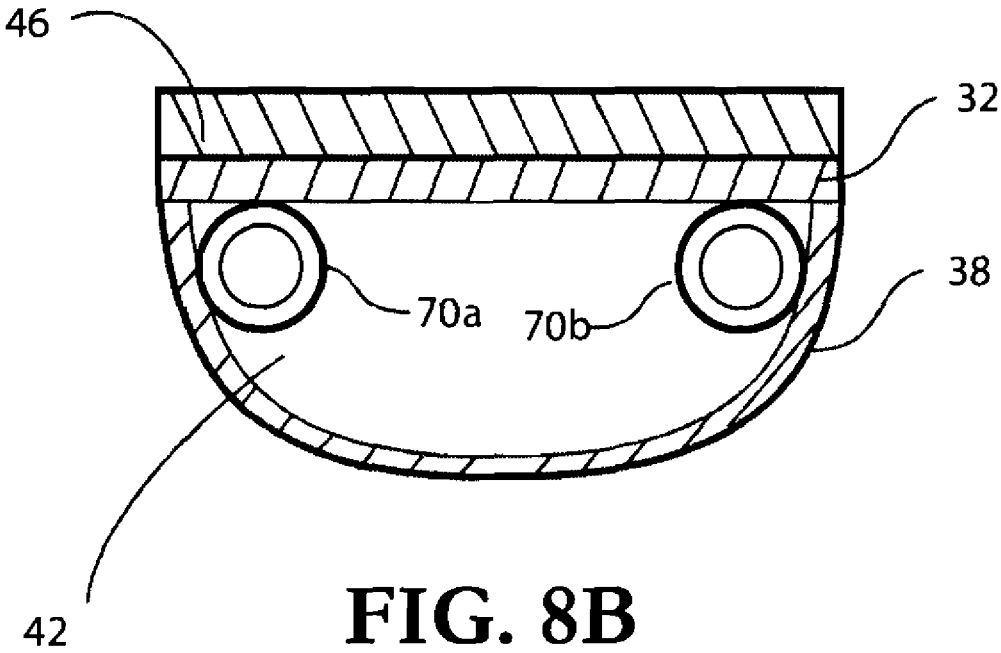

Persons of ordinary skill in the art also will understand that reinforcing tube 70 may include more than one tube. For example, FIG. 7B illustrates the underside of an alternative exemplary soundboard 32*b* that includes a pair of reinforcing tubes 70*a* and 70*b* that are disposed along neck portion 72 of soundboard 32*b*. FIG. 8B illustrates a corresponding cross-sectional view of neck 38 with soundboard 32*b* attached, showing reinforcing tubes 70*a* and 70*b* disposed inside hollow cavity 42.

Figure 7C:
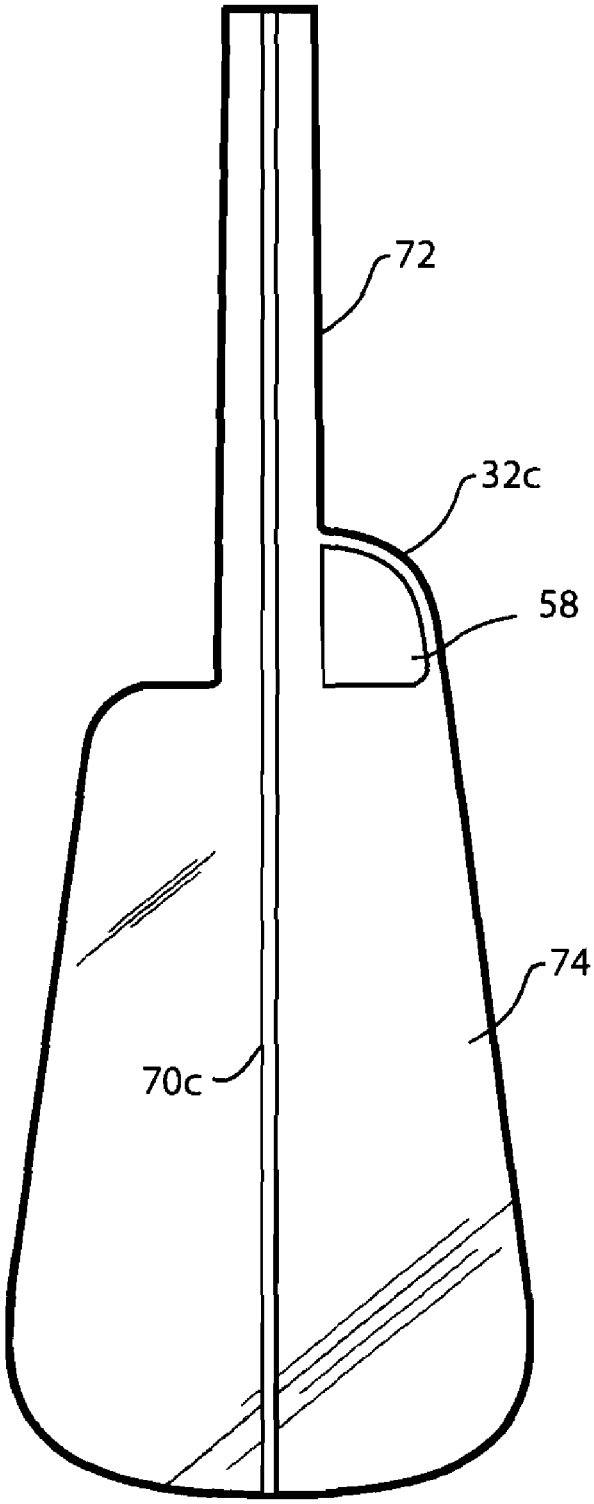
Figure 7D:
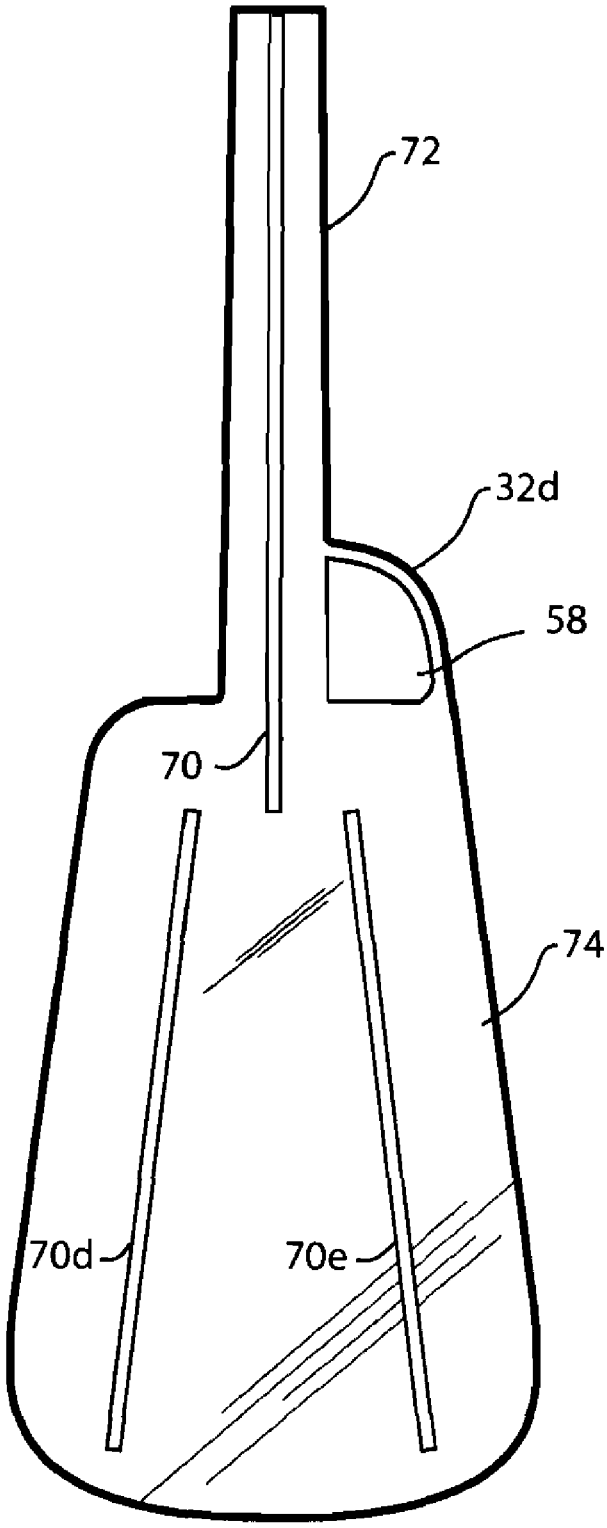

In addition to using one or more tubes 70 to stiffen neck portion 72 of soundboard 38, it also may be desirable to add stiffness to other portions of soundboard 38. For example, FIG. 7C illustrates the underside of an alternative exemplary soundboard 32*c* that includes a reinforcing tube 70*c* that is disposed along, and adds stiffness to, neck portion 72 and body portion 74 of soundboard 32*c*. Persons of ordinary skill in the art also will understand that reinforcing tube 70*c* may include more than one tube. For example, FIG. 7D illustrates the underside of another alternative exemplary soundboard 32*d* that includes a reinforcing tube 70 disposed along neck portion 72 of soundboard 32*d*, and a pair of reinforcing tubes 70*d* and 70*e* disposed along body portion 74 of soundboard 32*d*. By using such reinforcing tubes, soundboard 32*c* may be made thin and light, and yet have sufficient stiffness to reinforce neck 38 and maintain bridge 50 in its desired position.

Person of ordinary skill in the art will understand that still other techniques may be used to provide structural support for neck 38. For example, if unitary shell 34 is fabricated using composite manufacturing techniques, additional reinforcing materials, such as core material, described in more detail below, may be used in neck 38 to strengthen neck 38.

Figure 9:
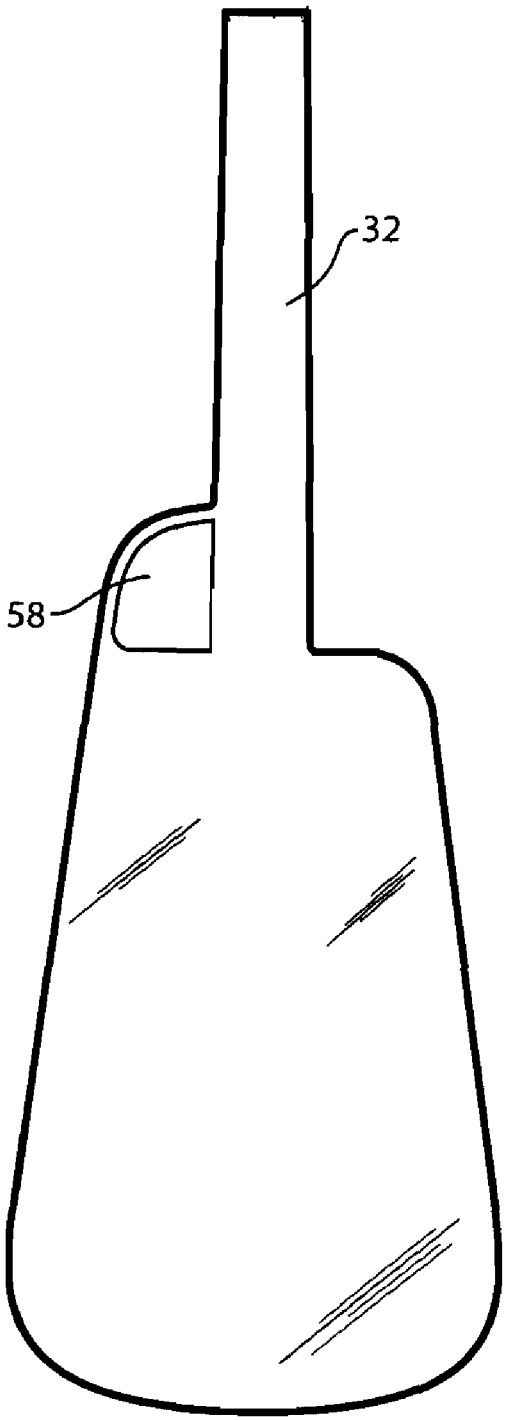
FIG. 9 is a top plan view of an exemplary soundboard in accordance with this invention.
Figure 10:
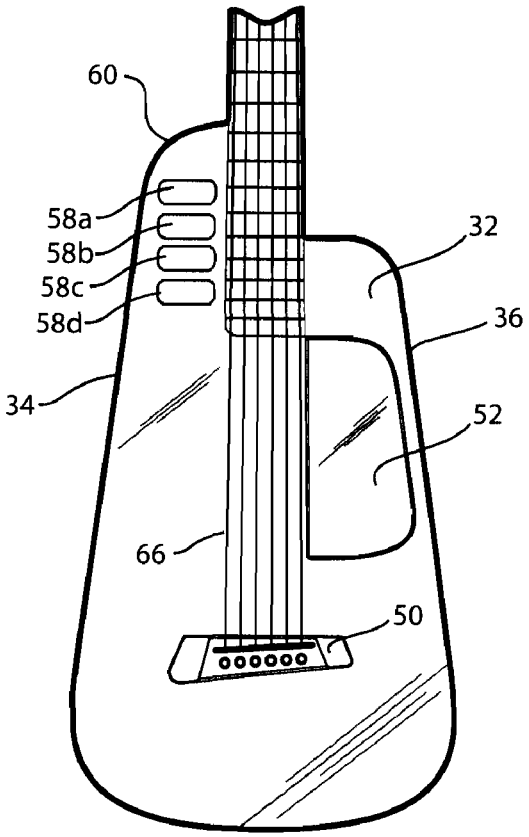
FIG. 10 is a partial top plan view of an alternative exemplary soundboard in accordance with this invention.

Referring now to FIGS. 2 and 9, soundboard 32 extends from nut 44 at head 40, along neck 38 to body 36, and includes first sound hole 58 that communicates with cavity 42. Persons of ordinary skill in the art will understand that first sound hole 58 may include more than one sound hole. For example, as shown in FIG. 10, first sound hole 58 may include a plurality of first sound holes 58*a*-58*d* that communicate with cavity 42. Although first sound holes 58*a*-58*d* are substantially equally-sized, persons of ordinary skill in the art will understand that first sound holes 58*a*-58*d* may have different sizes. Additionally, although first sound holes 58*a*-58*d* preferably have an elongated shape, persons of ordinary skill in the art will understand that first sound holes 58*a*-58*d* may have shapes other than elongate, and that the shapes of first sound holes 58*a*-58*d* may be the same or be different.

Figure 11A:
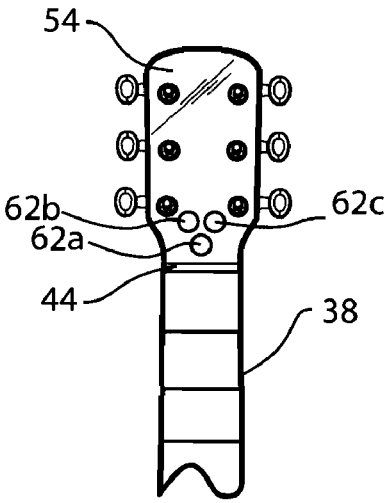
FIGS. 11A and 11B are partial top plan views of alternative exemplary heads in accordance with this invention.
Figure 11B:
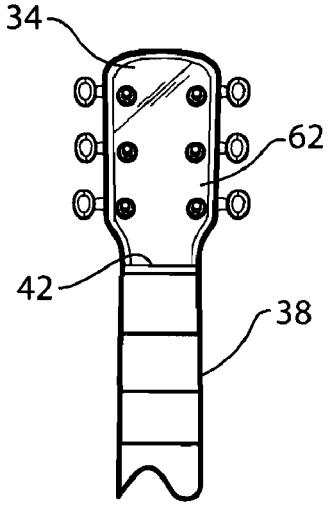

Referring to FIGS. 2 and 11, head top 54 includes second sound hole 62 that communicates with cavity 42. Persons of ordinary skill in the art will understand that second sound hole 62 may include more than one sound hole. For example, as shown in FIG. 11A, second sound hole 62 may include a plurality of sound holes 62*a*-62*b* that communicate with cavity 42. Although second sound holes 62*a*-62*c* are substantially equally-sized, persons of ordinary skill in the art will understand that second sound holes 62*a*-62*c* may have different sizes. Additionally, although second sound holes 62*a*-62*c* preferably have a circular shape, persons of ordinary skill in the art will understand that second sound holes 62*a*-62*c* may have shapes other than circular, and that the shapes of second sound holes 62*a*-62*c* may be the same or may be different. As shown in FIG. 11B, head top 54 optionally may be eliminated from head 40, whereby the opening of cavity 42 at head 40 effectively forms second sound hole 62.

Figure 12A:
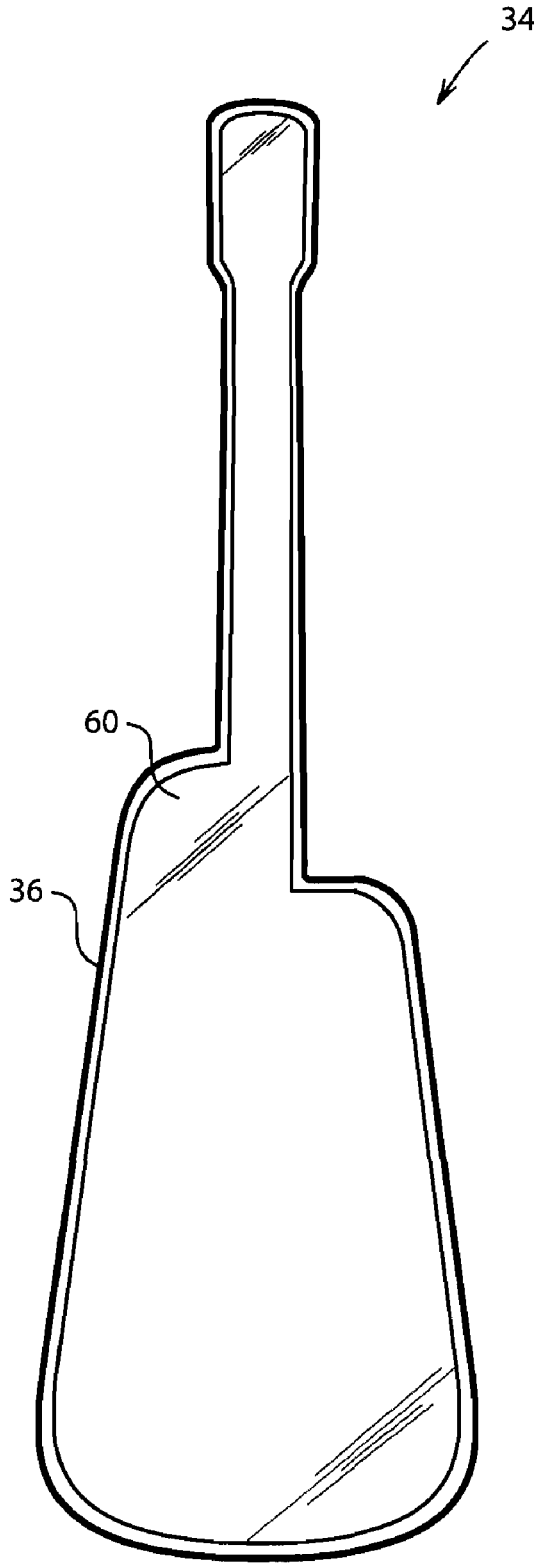
FIGS. 12A-12C are top plan views of alternative exemplary unitary shells in accordance with this invention.
Figure 12B:
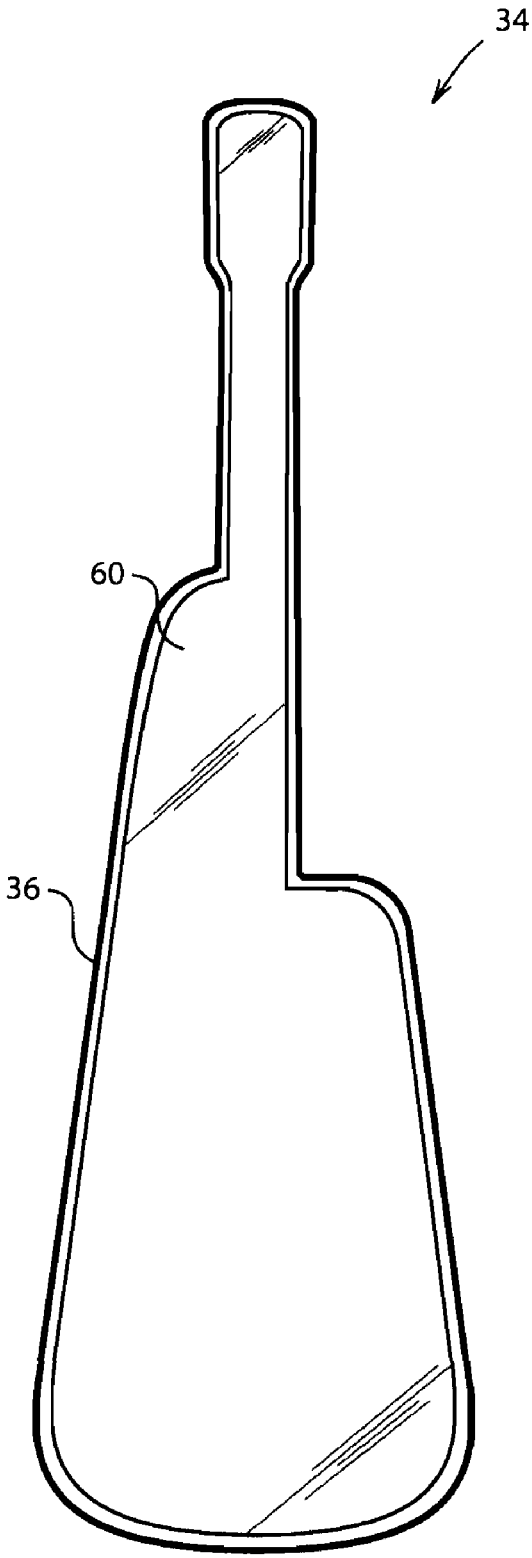
Figure 12C:
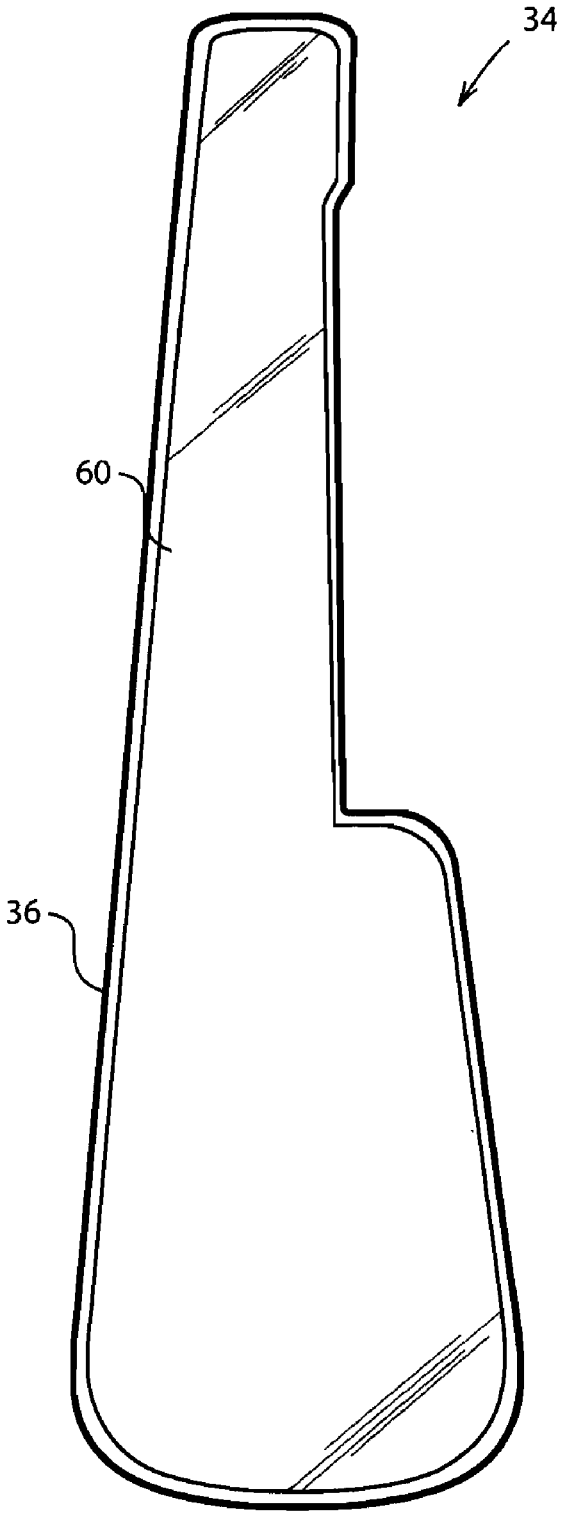
Figure 13A:
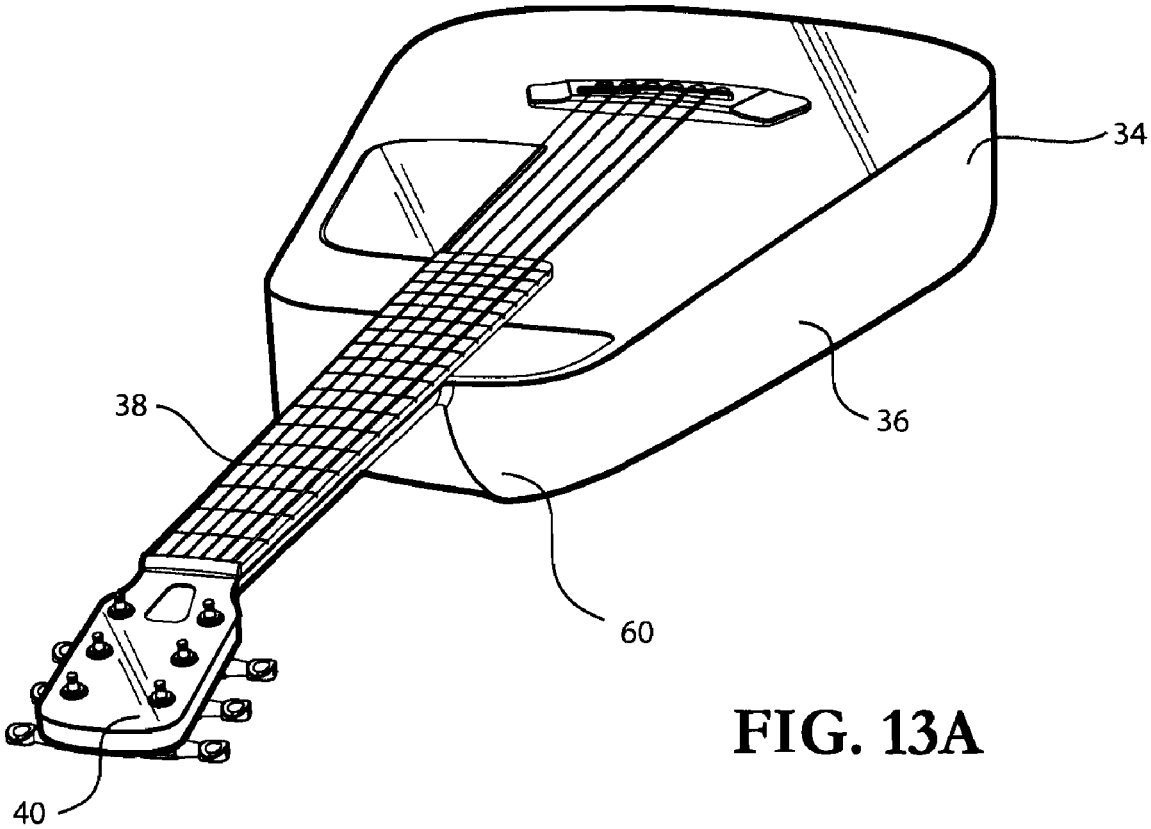
FIGS. 13A-13C are perspective side views of alternative exemplary stringed instruments in accordance with this invention.
Figure 13B:
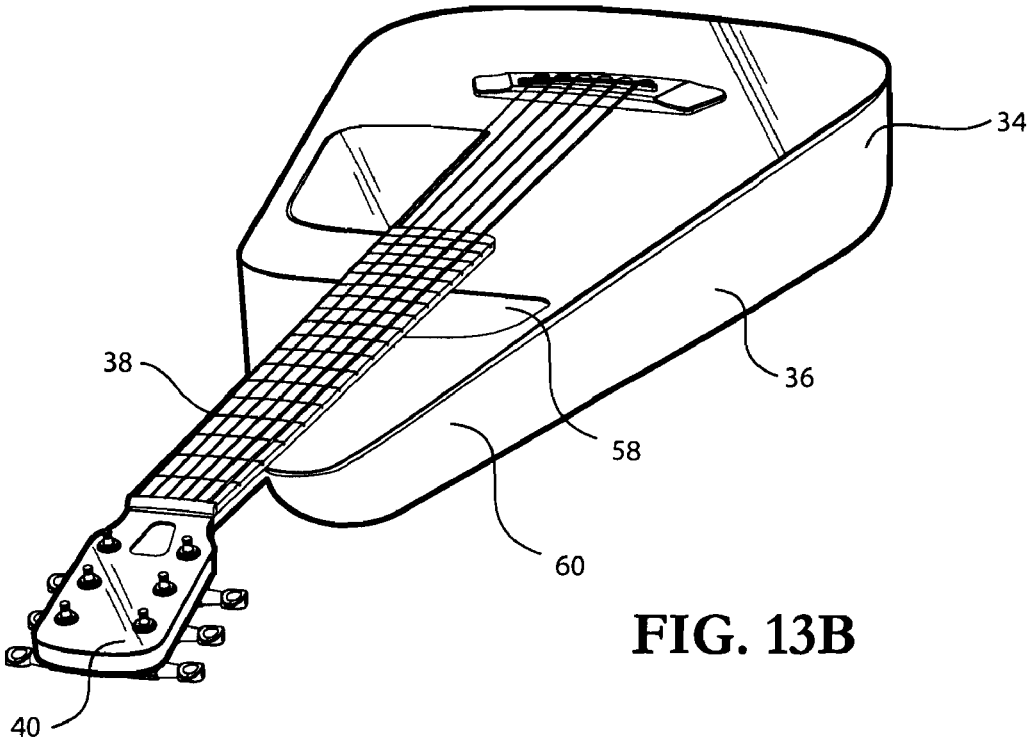

Referring now to FIGS. 12 and 13, and as described above, unitary shell 34 includes body 36, neck 38 and head 40, and cavity 42 extends from head 40 through neck 38 to body 36. Unitary shell 34 has an edge 80 that is mated with a bottom surface of soundboard 32 (not shown) to assist in creating a strong bond when soundboard 32 is fixedly attached to unitary shell 34.

Figure 13C:
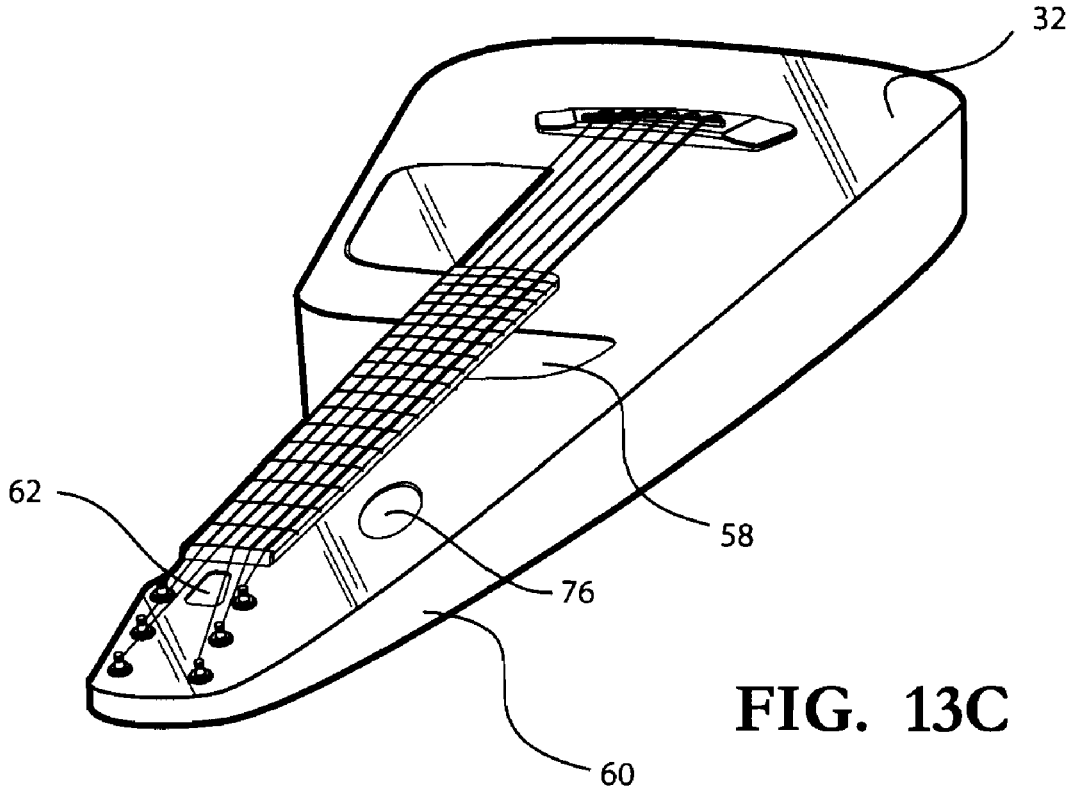

Several features of unitary shell 34 are designed to increase the resonance of stringed instrument 30. First, by providing a cavity 42 that extends from head 40 through neck 38 to body 36, cavity 42 effectively forms a large resonance chamber. In addition, as shown in FIG. 12A, body extension 60 extends toward head 40 and effectively enlarges the area of body 36 beyond the traditional body/neck joint in a conventional stringed instrument without substantially increasing the overall dimensions of the stringed instrument. In addition, body extension 60 provides a convenient area for locating first sound hole 58 away from the traditional central location used in conventional stringed instruments, which tends to decrease the resonance of such instruments. As shown in FIGS. 12B and 12C, body extension 60 may be extend to or past head 40 to further enlarge the resonance chamber. Additionally, as shown in FIG. 13C, a third sound hole 76 may be placed on the body extension 60 in various locations to project the resonance produced therein.

Figure 14A:
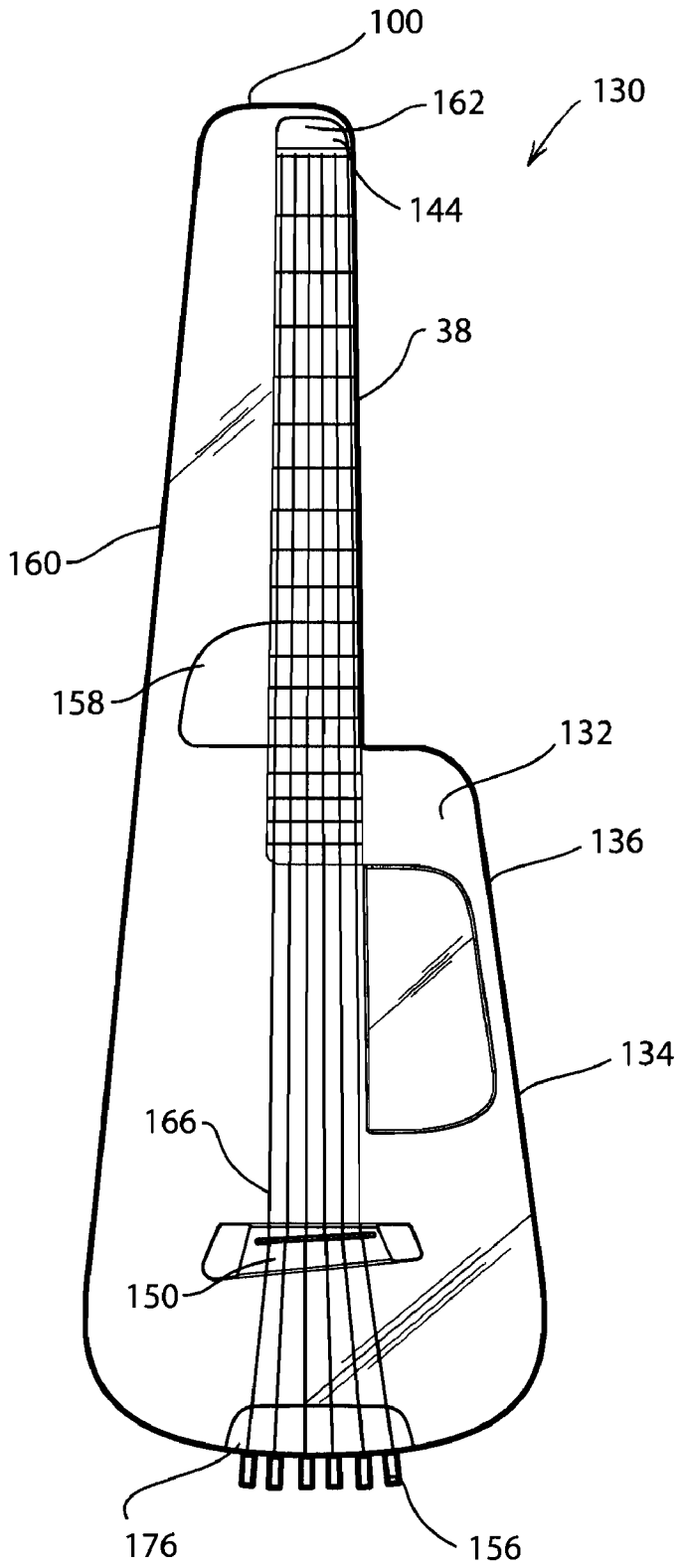
FIGS. 14A and 14B are top plan view and perspective side views of an alternative exemplary stringed instrument in accordance with this invention.
Figure 14B:
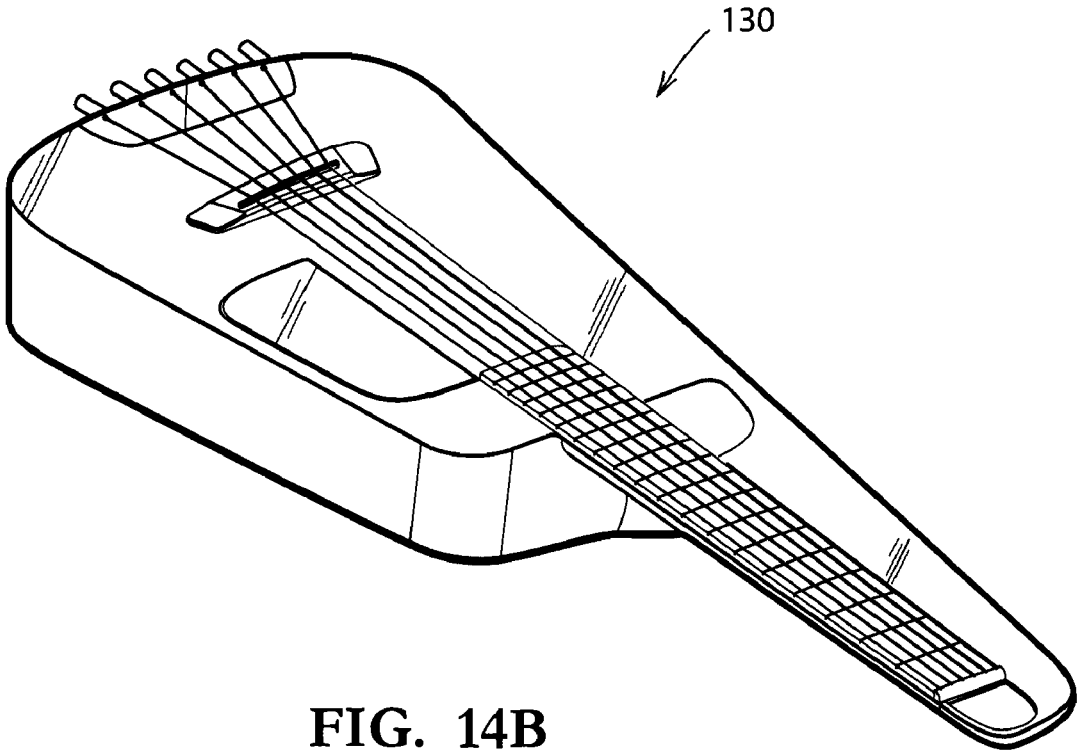

Referring now to FIG. 14, an alternative exemplary stringed instrument in accordance with this invention is described. In particular, stringed instrument 130 is a "headless" instrument that includes a soundboard 132 and a unitary shell 134 that includes a body 136 and a neck 138. Unitary shell 134 includes a cavity 142 extending from body 136 to neck 138, and soundboard 132 extends from body 136 to a top portion 100 of neck 138. Soundboard 132 includes a first sound hole 158 near body extension 160, a second sound hole 162 near top portion 100, and a third sound hole 176 near a bottom of body 136. Strings 166 stretch from bridge 150 to nut 144, and are attached to tuners 156. When soundboard 132 and unitary shell 134 are joined, cavity 142 forms an elongated resonance chamber that communicates with first sound hole 158, second sound hole 162 and third sound hole 176, and that extends from body 136 through neck 38 to top portion 100.

Figure 15:
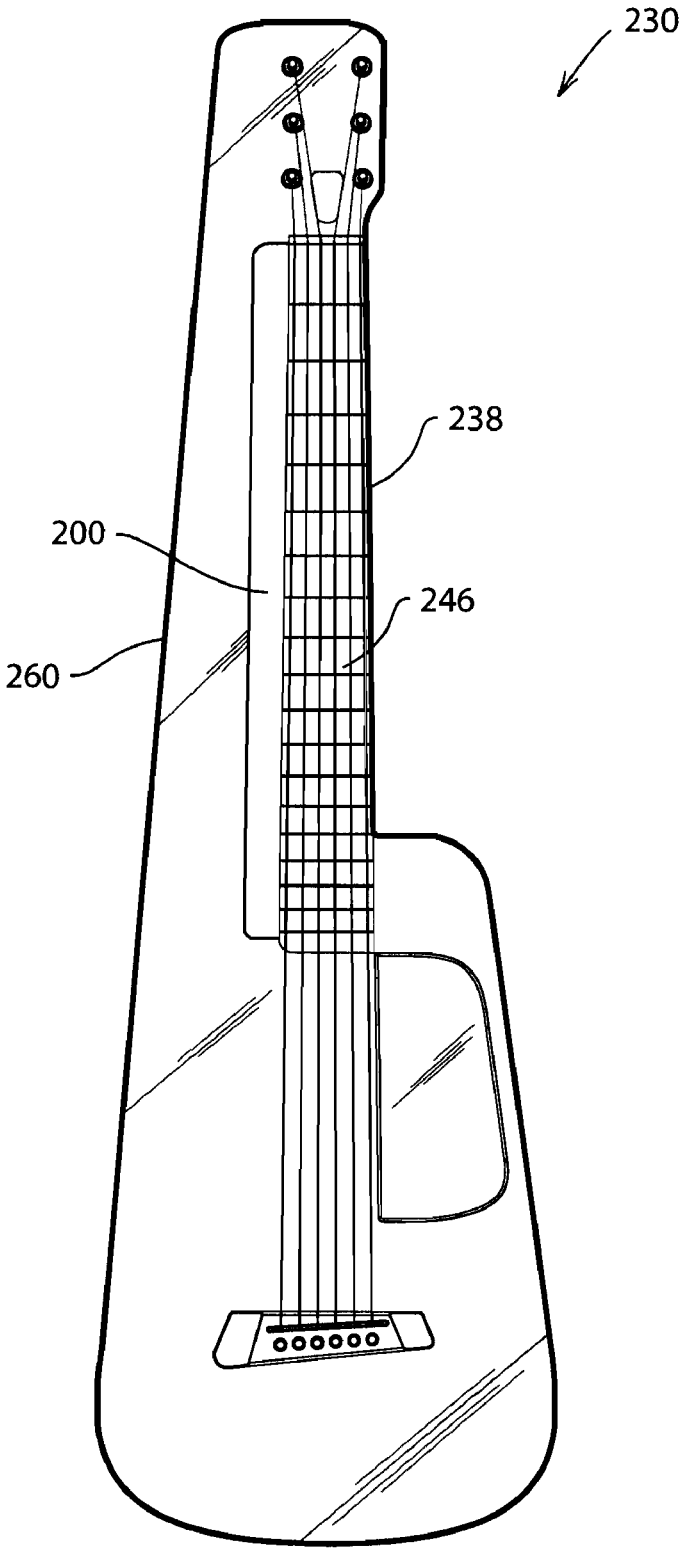
FIG. 15 is a top plan view of another alternative exemplary stringed instrument in accordance with this invention with a center void.

Referring now to FIG. 15, another alternative exemplary stringed instrument in accordance with this invention is described. In particular, stringed instrument 230 includes a body extension 260 separated from neck 238 by a center void section 200 that allows a user to have better fingertip access to fingerboard 246.

As described above, unitary shell 34 may be formed by composite manufacturing processes, such as vacuum bagging and vacuum infusion. In such processes, unitary shell 34 is formed with a single female mold, which allows for relatively low tooling costs verses multiple mold methods. The mold can be made of any material that will survive the curing conditions. Mold preferably are made of aluminum, composites, stainless steel, or other similar materials. The mold is typically coated with a mold-release agent, as known in the art, and is then covered with one or more layers of a fiber cloth, resin, optionally a core material, described in more detail below, and one or more additional layers of fiber cloth. The fiber cloth may include carbon, aramid, boron, silicon carbide, or tungsten fiber cloth or other similar fiber cloths, and the resin may include epoxy, polyester, biocomposite, vinylester, or phenolic resins, or other similar resins.

Vacuum bagging is an exemplary low cost manufacturing process for creating unitary shell 34. Vacuum bagging creates mechanical pressure on the fiber fabric during the resin cure cycle. Pressurizing a composite lamination removes trapped air between layers, compacts the fiber layers for efficient force transmission among fiber bundles and prevents shifting of fiber orientation during cure, reduces humidity, and optimizes the fiber-to-resin ratio in the composite part.

Vacuum infusion is an alternative exemplary manufacturing process for creating unitary shell 34. In particular, vacuum infusion is generally a preferred method of manufacture with resin infused parts for obtaining higher strength-to-weight ratios than traditional vacuum bagging. Vacuum infusion also has a relatively low cost of tooling with more highly controlled fabric and layout and resin content. Like vacuum bagging, vacuum infusion uses vacuum pressure to drive resin into the layers of fabric laid into the female mold. Unlike vacuum bagging the reinforcement cloth is carefully arranged and laid dry into the mold and the vacuum is applied before resin is introduced. Once a complete vacuum is achieved, resin is sucked into the laminate via carefully placed tubing.

Unitary shell 34 alternatively may be manufactured using male and female mold pieces that have a receptacle area that is shaped to form shell 34. The molds have similar requirements to those used in vacuum bagging and vacuum infusion. The mold pieces are then mated, clamped tightly, and the resin is cured to fully harden the polymeric material.

In preferred embodiments, the number of layers of fiber cloth is selected to produce a thickness of the cured composite material that is preferably in the range of about 1 to 7 mm. The number of layers of fiber cloth used will depend on the properties of the cloth, and typically ranges from 2 to 9 cloth layers. When two or more pieces of the same type fiber cloth are laid adjacent, they form essentially one layer of that type of material in the final cured composite.

The fiber cloth pieces may be already impregnated with resin ("prepreg"). Otherwise, or if more resin is needed, additional resin may be added to saturate or fully impregnate the cloth layers after they are laid in the mold pieces. As is well known to practitioners, sufficient resin must be added so that the cured composite does not have voids of a number that degrade its mechanical properties. For example, the fiber-resin composite may be cured by resin transfer molding, structural reaction injection molding, resin film infusion, autoclave molding, compression molding, or other similar molding processes.

Fiber cloth pieces impregnated in a thermoplastic, such as unidirectional carbon fiber and polypropylene, may also be used to form shell 34. Thermoplastic "prepreg" is more inexpensive then resin prepreg, allows for more consistent parts and faster production cycles by eliminating curing. Compression molding, hydroforming, matched die forming and thermoforming are all suitable molding processes.

For added strength, unidirectional and bidirectional fiber cloths may be used. Unidirectional fiber cloth has maximal stiffness and strength in one direction, and allows for the highest concentration of cloth reinforcement strands in one direction. Unidirectional fiber cloth is particularly useful in the relatively thin neck 38, which requires significant stiffness to counter the tension of the strings. To achieve the desired stiffness, 1-6 layers of unidirectional fiber cloth are laid in the neck section of the mold, with the strands oriented parallel to the strings. Unidirectional fiber may also be oriented at a 90 or 45 degree angle to the strings to enhance twisting stiffness. Bidirectional fiber cloth exhibits strength and stiffness in two directions, and is thus used in one or multiple layers on the exterior and interior of the instrument to provide resiliency.

As is well known to practitioners, the fiber cloth and resin matrix may be significantly thickened and therefore strengthened with the use of a core material. To be effective, the core material is placed between two or more layers of fiber cloth. This methodology is utilized both in body 36, neck 38 and head 40. The core may be unpatterned, or may be patterned, such as a honeycomb. Due to cost, a preferred material is a 2 mm thick fabric with a honeycomb pattern, such as Lantor Soric, manufactured Lantor BV, Veenendaal, The Netherlands. Other core materials made from foam, wood, metal and plastics with or without a pattern may also be used. To reduce weight, some core material may be removed from areas that do not require increased stiffness, such as the back of the body 36.

Alternatively, unitary shell 34 may be fabricated by applying a fiber-reinforced mixture such as glass and epoxy onto a undersized polyurethane foam core (referred to herein as a "preform"). The preform is then placed into a matched cavity mold, and heat and pressure are applied to cure the resin. Other materials suitable for this process include biodegradable materials, such as Zelfo, manufactured by Zelfo Australia, Mullumbimby, Australia. Zelfo is a fiber-reinforced mixture made solely out of plant fibers, that can be created in a number of configurations including hemp and sugar.

As an alternative to composite manufacturing processes, unitary shell 34 may be formed from a plastics material (e.g., polycarbonate, fiber reinforced nylon, acrylonitrile butadiene styrene, phenolic or other similar plastics material) without a fiber cloth. For example, unitary shell 34 may be fabricated by injection molding, compression molding, vacuum-forming or other similar techniques.

As described above, soundboard 32 ideally is thin and light, yet sufficiently stiff for efficiently communicating sound from strings 66 to cavity 42. Preferably, soundboard 32 is between 0.5 mm to 4 mm thick. Soundboard 32 may be manufactured from a fabric resin matrix, plastics, fiber-reinforced plastics, ceramics or wood. In a preferred embodiment, soundboard 32 is 1 mm thick, and is made with both unidirectional and bi-directional pre-preg carbon and glass fibers. Soundboard 32 also may be manufactured with a core material. Soundboard 32 also may be manufactured with a core material such as Nomex®, an aramid honeycomb manufactured by E.I. du Pont de Nemours and Company, Wilmington, Del., USA. Persons of ordinary skill in the art will understand that other core materials may also used. A preferred method of manufacturing is compression molding or autoclaving. Vacuum-bagging, vacuum-infusion and other techniques also may be used.

Figure 16:
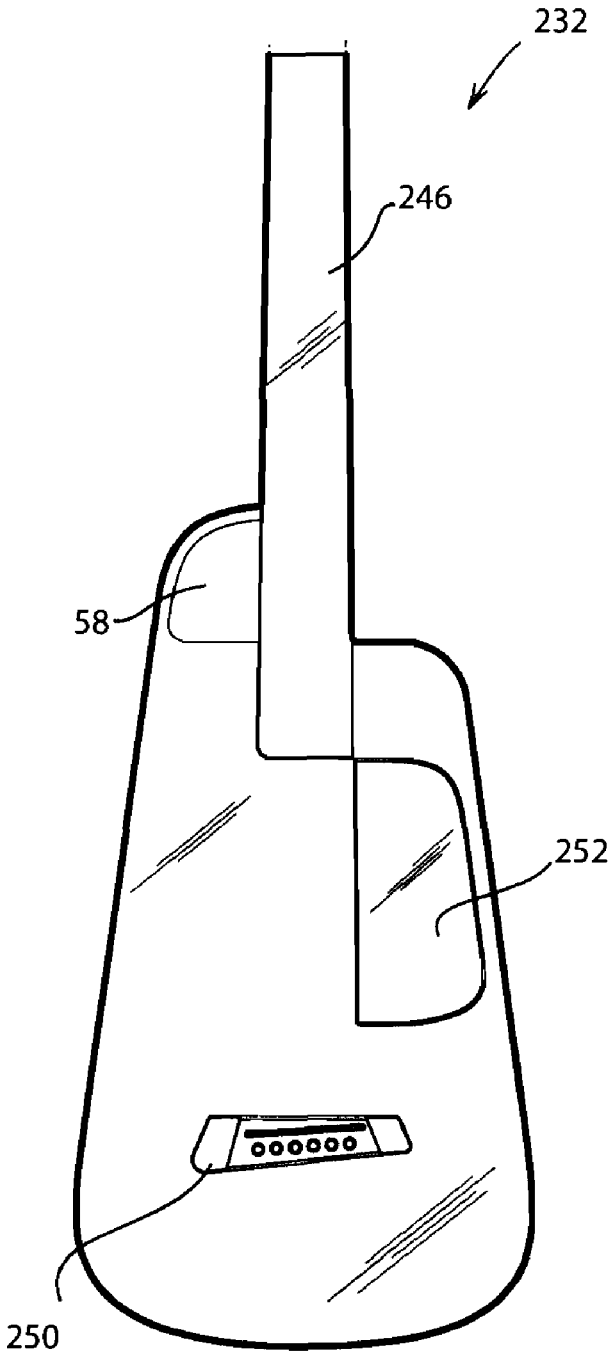
FIG. 16 is a top plan view of an alternative exemplary sound board in accordance with this invention.

Referring now to FIG. 16, an alternate soundboard in accordance with this invention is described. In particular, soundboard 332 includes integral fingerboard 346, bridge 350 and pickguard 352, all manufactured as one unitary part. By way of example and not by way of limitation, this part may be constructed from a composite fabric and binding agent inserted a mold that is formed around a negative impression of the final part. A solid head may also be used with this embodiment to increase the structural integrity of the instrument.

The foregoing merely illustrates the principles of this invention, and various modifications can be made by persons of ordinary skill in the art without departing from the scope and spirit of this invention. For example, stringed instruments in accordance with this invention may also include an electronic pick-up which may be coupled to an amplifying device to broadcast the sound produced further.

The invention claimed is:

1. A stringed musical instrument comprising:

a unitary shell comprising a head, a neck and a body;

a separate sound board to be attached to the unitary shell, wherein the soundboard extends from the head to the body; and a substantially hollow cavity in the unitary shell extending through the head, the neck and the body.

2. The instrument of claim 1, wherein the unitary shell is a molded unitary shell.

3. The instrument of claim 1, wherein the unitary shell comprises a fiber cloth and resin composite material.

4. The instrument of claim 3, wherein the resin is selected from epoxy, polyester, biocomposite, vinylester and phenolic resins.

5. The instrument of claim 3, wherein the fiber cloth is selected from carbon, aramid, boron, silicon carbide, and tungsten.

6. The instrument of claim 1, wherein the unitary shell comprises a plastics material.

7. The instrument of claim 1, wherein the sound board comprises any of wood, resin matrix fiber-reinforced composite, ceramics and plastics.

8. The instrument of claim 1, further comprising a first sound hole adjacent the body.

9. The instrument of claim 1, further comprising a second sound hole adjacent the head.

10. The instrument of claim 1, wherein the neck further comprises a bracing element.

11. The instrument of claim 10, wherein the bracing element comprises a reinforcing tube disposed in a neck portion of the soundboard.

12. The instrument of claim 1, further comprising a reinforcing tube disposed in a body portion of the soundboard.

13. The instrument of claim 1, wherein the body comprises a body extension that extends toward the head.

14. The instrument of claim 1, wherein the soundboard further comprises any of an integral bridge, a fingerboard and a pickguard.

15. The musical instrument of claim 1, wherein the musical instrument comprises any of an acoustic guitar, a classical guitar, a twelve-string guitar, an electric guitar, an electric acoustic guitar, a jazz guitar, a harp guitar, a violin, a viola, a cello, a bass, a double bass, a cittern, a lute, a mandolin, a mandola, a mandocello, a ukulele and a banjo.

16. A process for manufacturing a composite stringed musical instrument, the process comprising:

providing a mold to form a unitary shell comprising a head, a neck and a body;

providing a plurality of pieces of fiber cloth in the mold;

adding a resin to saturate the fiber cloth;

applying pressure to the fiber cloth in the mold;

curing the resin to form the unitary shell;

attaching a separate sound board the unitary shell, wherein the soundboard extends from the head to the body; and providing a substantially hollow cavity in the unitary shell extending through the head, the neck and the body.

17. The process of claim 16, wherein the process comprises any of a vacuum bagging and a vacuum infusion process.

18. The process of claim 16, further comprising providing a plurality of unidirectional fiber cloth in the neck section of the mold, with strands oriented substantially parallel to the strings.

19. The process of claim 18, further comprising providing a plurality of unidirectional fiber cloth in the neck section of the mold, with strands oriented at any of a 45 and a 90 degree angle to the strings.

20. The process of claim 16, further comprising providing a layer of bidirectional fiber cloth on the exterior and/or interior of the instrument.

21. The process of claim 16, further comprising providing a core material between layers of the fiber cloth.

* * * * *